US007301502B2

(12) United States Patent
Sinasi et al.

(10) Patent No.: US 7,301,502 B2
(45) Date of Patent: Nov. 27, 2007

(54) ANTENNA ARRANGEMENT FOR A CELLULAR COMMUNICATION TERMINAL

(75) Inventors: Ozden Sinasi, Copenhagen (DK); Dennis Sejersgaard-Jacobsen, Brønshøj (DK)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/208,392

(22) Filed: Aug. 18, 2005

(65) Prior Publication Data

US 2007/0040752 A1 Feb. 22, 2007

(51) Int. Cl.
*H01Q 1/24* (2006.01)

(52) U.S. Cl. ..... 343/702; 343/745; 343/846; 343/876

(58) Field of Classification Search ..... 343/700 MS, 343/702, 745, 749, 829, 833, 846, 876
See application file for complete search history.

(56) References Cited

U.S. PATENT DOCUMENTS

| | | | | |
|---|---|---|---|---|
| 6,765,536 | B2 | 7/2004 | Phillips et al. | 343/702 |
| 7,099,690 | B2 * | 8/2006 | Milosavljevic | 455/552.1 |
| 2002/0105471 | A1 * | 8/2002 | Kojima et al. | 343/749 |
| 2004/0041733 | A1 * | 3/2004 | Milosavljevic | 343/700 MS |

FOREIGN PATENT DOCUMENTS

| | | | |
|---|---|---|---|
| EP | 1396906 | A1 | 3/2004 |
| GB | 2373637 | A | 9/2002 |
| JP | 2002/232224 | | 8/2002 |
| JP | 2004 128660 | | 4/2004 |
| WO | WO-2005/069439 | A1 | 7/2005 |

OTHER PUBLICATIONS

Product Brochure, "NEC RFIC Switches", www.cel.com/pdf/marketsheets/switches.pdf, no daed provided.

* cited by examiner

*Primary Examiner*—Tho Phan
(74) *Attorney, Agent, or Firm*—Harrington & Smith, PC

(57) ABSTRACT

An antenna arrangement operable to transmit/receive in a first communications band and a second communications band, including a ground plane; a first conductive element for transmitting/receiving; a second conductive element separate from the first conductive element and the ground plane and having a first portion proximal to, but separated from the first conductive element and a second portion proximal to, but separated from the ground plane; and a switch element for connecting/disconnecting the second conductive element to the ground plane, wherein, the first conductive element, when the switch element disconnects the second conductive element from the ground plane, is operable to transmit/receive in a first communications band and is inoperable to transmit/receive in a second communications band and the first conductive element, when the switch element disconnects the second conductive element from the ground plane, is operable to transmit/receive in the second communications band and inoperable to transmit/receive in the first communications band.

17 Claims, 2 Drawing Sheets

ANTENNA ARRANGEMENT FOR A CELLULAR COMMUNICATION TERMINAL

FIELD OF THE INVENTION

Embodiments of the present invention relate to antenna arrangements that are suitable for cellular communication terminals.

BACKGROUND TO THE INVENTION

Currently there is a trend towards making antennas for hand-held radio frequency cellular communication terminals smaller so that they can easily fit within small terminals. Examples of small terminals include flip or slide mobile cellular telephones. However, when an antenna is made smaller the bandwidths associated with its resonances tend to decrease.

Modern mobile cellular communication terminals are typically multi-band terminals and may be multi-mode. A multi-mode terminal is able to operate using one of several different protocols. For example, a multi-mode terminal may be able to transmit/receive using GSM or WCDMA protocols. A multi-band terminal is able to transmit/receive using different licensed frequency bands. The GSM licensed frequency bands are US-GSM (824-894 MHz), E-GSM (880-960 MHz), PCN1800 (1710-1880 MHz), PCS1900 (1850-1990 MHz The WCDMA licensed frequency bands are US-WCDMA1900 (1850-1990); WCDMA21000 (Tx: 1920-1980I Rx: 2110-2180).

Typically an antenna used is a GSM multi-band terminal has two resonances. The bandwidth of the lowest resonance is suitable for covering the US-GSM and/or E-GSM communication bands and the second lowest resonance is suitable for covering the PCN and/or PCS communication bands. The bandwidth of the second lowest resonant mode is not wide enough to cover the WCDMA2100 communication band. Therefore a single small antenna cannot be used in a multi-mode/band terminal to cover the four GSM bands and also the WCDMA2100 band.

It would therefore be desirable to be able to modify an antenna so that one of its resonances is adapted to cover a desired communication band while maintaining acceptable performance of the antenna for other communication bands.

In particular, it would be desirable to be able to modify an antenna so that the bandwidth of its second lowest resonance is increased to cover the WCDMA2100 communication band while also maintaining acceptable performance of the antenna in the GSM communication bands.

BRIEF DESCRIPTION OF THE INVENTION

According to one embodiment of the invention there is provided an antenna arrangement operable to transmit/receive in a first communications band and a second communications band, comprising: a ground plane; a first conductive element for transmitting/receiving; a second conductive element separate from the first conductive element and the ground plane and having a first portion proximal to, but separated from the first conductive element and a second portion proximal to, but separated from the ground plane; and a switch element for connecting/disconnecting the second conductive element to the ground plane, wherein, the first conductive element, when the switch element disconnects the second conductive element from the ground plane, is operable to transmit/receive in a first communications band and is inoperable to transmit/receive in a second communications band and the first conductive element, when the switch element connects the second conductive element to the ground plane, is operable to transmit/receive in the second communications band and inoperable to transmit/receive in the first communications band.

According to another embodiment of the invention there is provided a method of selectively controlling an antenna arrangement to operate in at least a first communications band or to operate in at least a second communications band, comprising: controlling a resonance of a first conductive element to enable operation in the first communications band but disable operation in the second communications band by disconnecting a second conductive element from a ground plane, where the second conductive element is separate from the first conductive element and the ground plane and has a first portion proximal to, but separated from the first conductive element and a second portion proximal to, but separated from the ground plane; and controlling the resonance of the first conductive element to enable operation in the second communications band and disable operation in the first communications band by connecting the second conductive element to the ground plane.

The terms 'inoperable' or 'disable operation' are comparative and not necessarily absolute. The term 'inoperable' implies that the efficiency of the first conductive element at transmitting/receiving in the second communications band when the switch element disconnects the second conductive element from the ground plane is less than that when the switch element connects the second conductive element to the ground plane. 'Inoperable' is not intended to exclude the possibility that the first conductive element may actually be able to transmit/receive in the second communications band to some limited extent when the switch element disconnects the second conductive element from the ground plane. Likewise, the term 'inoperable' implies that the efficiency of the first conductive element at transmitting/receiving in the first communications band when the switch element connects the second conductive element to the ground plane is less than that when the switch element disconnects the second conductive element to the ground plane. 'Inoperable' is not intended to exclude the possibility that the first conductive element may actually be able to transmit/receive in the first communications band to some limited extent when the switch element connects the second conductive element to the ground plane.

According to another embodiment of the invention there is provided an antenna arrangement comprising: a ground plane; a first conductive element having a first resonance and a second resonance; a second conductive element separate from the first conductive element and the ground plane and arranged to be closer to the ground plane than the first conductive element; and a switch element for connecting/disconnecting the second conductive element to the ground plane.

According to another embodiment of the invention there is provided a method of selectively controlling an antenna arrangement to operate in at least a first communications band or to operate in at least a second communications band, comprising: controlling a resonance of a first conductive element to enable operation in the first communications band but disable operation in the second communications band by disconnecting a second conductive element from a ground plane, where the second conductive element is separate from the first conductive element and a ground plane and is located closer to the ground plane than to the first conductive element; and controlling the resonance of the first conductive element to enable operation in the second communications band and disable operation in the first communications band by connecting the second conductive element to the ground plane.

According to another embodiment of the invention there is provided an antenna arrangement comprising: a ground plane; a first conductive element having a first resonance and a second resonance; a second conductive element separate from the first conductive element and the ground plane, wherein the second conductive element has an electrical length corresponding to $\lambda/4$, where $\lambda$ is a wavelength of a frequency lying within the second communications band and the second conductive element is arranged so that a first terminating free-end portion of the second conductive element is proximal to the ground plane and a second portion of the second conductive element is proximal to the first conductive element; and a switch element for connecting/disconnecting the second conductive element to the ground plane.

The use of a switch element is important as it provides selective connection of the second conductive element to the ground plane and hence provides selective tuning of the first conductive element. The connection of the second conductive element to ground typically adjusts the first and second resonances of the first conductive element. Although this adjustment allows the first conductive element to cover a desired band that is not otherwise covered, it also degrades the performance of the first conductive element in a band or bands other than the desired band. The switch element therefore connects the second conductive element to ground, when the antenna arrangement is to cover the desired band and disconnects the second conductive element from ground when the antenna arrangement is to cover the other band(s).

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 1:
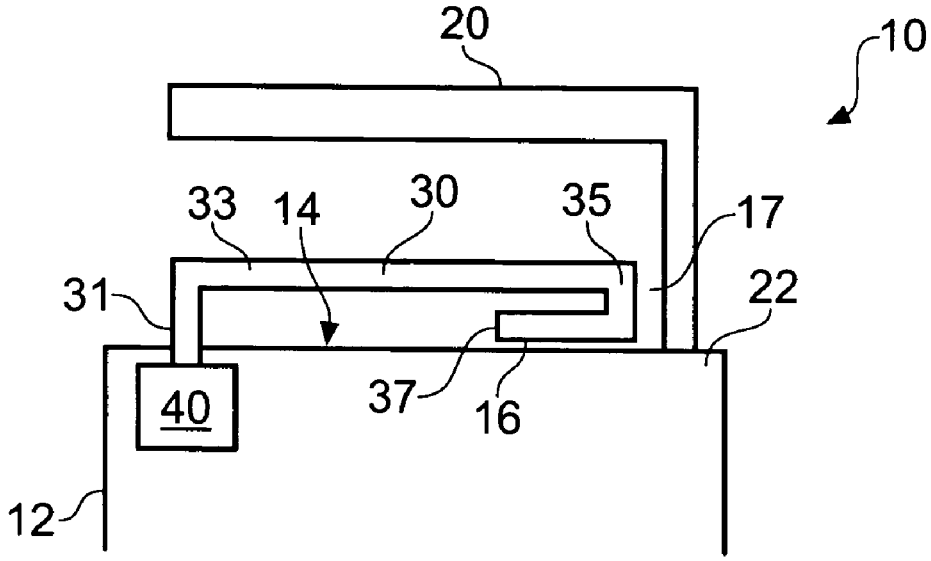
FIG. 1 schematically illustrates an active antenna arrangement.

FIG. 1 schematically illustrates an active antenna arrangement 10 comprising a first conductive element 20 that operates as a radiating element and is connected to a feed point 22; a second conductive element 30 that operates as a tuning element 30 that is distinct from the radiating element 20; a ground plane 12 that may be a printed wiring board (PWB) and a switch element 40. The antenna arrangement 10 is particularly suited for use in slide and flip/clamshell mobile cellular telephones.

The switch element 40 is positioned between the ground plane 12 and the tuning element 30. It is electronically controllable to be open or closed. It may, for example, be a field effect transistor. When the switch is closed the tuning element 30 is connected to the ground plane 12 so that there is a dc electric current path between the tuning element 30 and the ground plane 12. When the switch element 40 is open the tuning element 30 is not connected to the ground plane 12 and there is not a dc electric current path between the tuning element 30 and the ground plane 12.

When the tuning element 30 is disconnected from the ground plane 12, the radiating element 20 has one or more resonances that enable the radiating element 20 to transmit/receive efficiently in one or more communication bands but it does not have a sufficiently low input impedance at a target communication band to be able to efficiently transmit/receive in the target communication band. When the tuning element 30 is connected to the ground plane 12, it couples with the radiating element 20. This coupling adapts the one or more resonances of the radiating element 20 and enables the radiating element 20 to efficiently transmit/receive in the target band.

In more detail, in an example illustrated in FIG. 1, the radiating element 20 is a monopole antenna that has a single feed 22 and does not use the ground plane 12. The ground plane 12 does not underlie the radiating element 20. The bandwidth of such an antenna is dependent upon the antenna volume. Decreasing the antenna volume will decrease the antenna's bandwidths.

The tuning element 30 is made from conductive material such as metal foil. The tuning element 30 comprises, in this example, a portion 31 connected to the switch element 40, an elongate portion 33 that extends towards the feed point 22 of the radiating element 20, a bend portion 35 that runs parallel to a portion of the radiating element 20 near the feed point 22 and a return portion 37 that extends away from the feed point 22 substantially parallel to elongate portion 33 and that terminates at a free-end. The return portion 37 is positioned between the elongate portion 33 and the edge 14 of the ground plane 12. The tuning element 30 is very close to the ground plane 12. In the example illustrated, the return portion 37 and the ground plane 12 are separated by a gap 16 that is around 1 mm.

As the ground plane is very close to the free-end of the tuning element 30, strong coupling can occur between them. The ground plane 12 can, for example, absorb radiation from the tuning element 30 via capacitive coupling. The tuning element 30 does not itself radiate to a significant extent and is used only for coupling purpose and not for radiation.

The tuning element is separated by a gap 17 of around 2-6 mm from the antenna feed point 22 at its closest point to the radiating element 20 (bend portion 35). The gap 17 is greater than the gap 16.

As the feed point 22 of the radiating element 20 is very sensitive due to high H-field levels, the bend portion 35 of the tuning element 30 can easily couple to the radiating element 20 and thereby shift the resonant frequencies and bandwidths of the radiating element 20. The H-field of the radiating element 20 is strongest at the feed point 22. The proximity of the bend portion 35 of the tuning element 30 to where the H-field is strongest provides good inductive coupling between the radiating element 20 and the tuning element 30.

Figure 2:
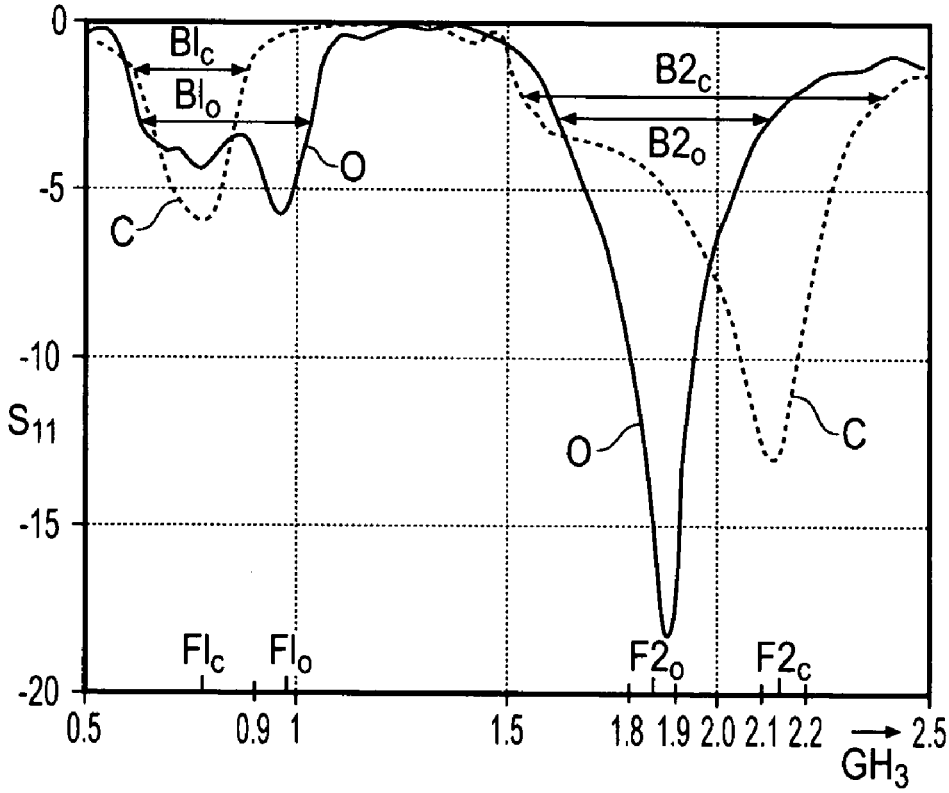
FIG. 2 graphs the input impedance of the antenna arrangement when it is in a GSM mode and when it is in a WCDMA2100 mode.

When the switch element 40 is open (GSM mode), the radiating element 20 covers the four GSM bands—US-GSM, E-GSM, PCN, PCS. The input impedance of the antenna arrangement S11 in the GSM mode is labeled O in FIG. 2.

When the switch element is closed (WCDMA mode), the radiating element 20 covers the WCDMA2100 band. The input impedance of the antenna arrangement S11 in the WCDMA mode is labeled C in FIG. 2.

It can be seen that on closing the switch element 40, the bandwidth of the lowest resonance decreases from B1*o* to B1*c* and its resonant frequency decreases from F1*o* to F1*c* and that the bandwidth of the second lowest resonance increases from B2*o* to B2*c* and its resonant frequency increases from F2*o* to F2*c*.

When the switch element 40 is closed, the bandwidth B1*c* does not cover E-GSM but does cover US-GSM and the bandwidth B2*c* does not effectively cover PCN or PCS, but covers WCDMA2100.

When the switch element 40 is open, the bandwidth B1*o* covers E-GSM and US-GSM and the bandwidth B2*o* covers PCN or PCS, but does not effectively cover WCDMA2100.

Figure 3A:
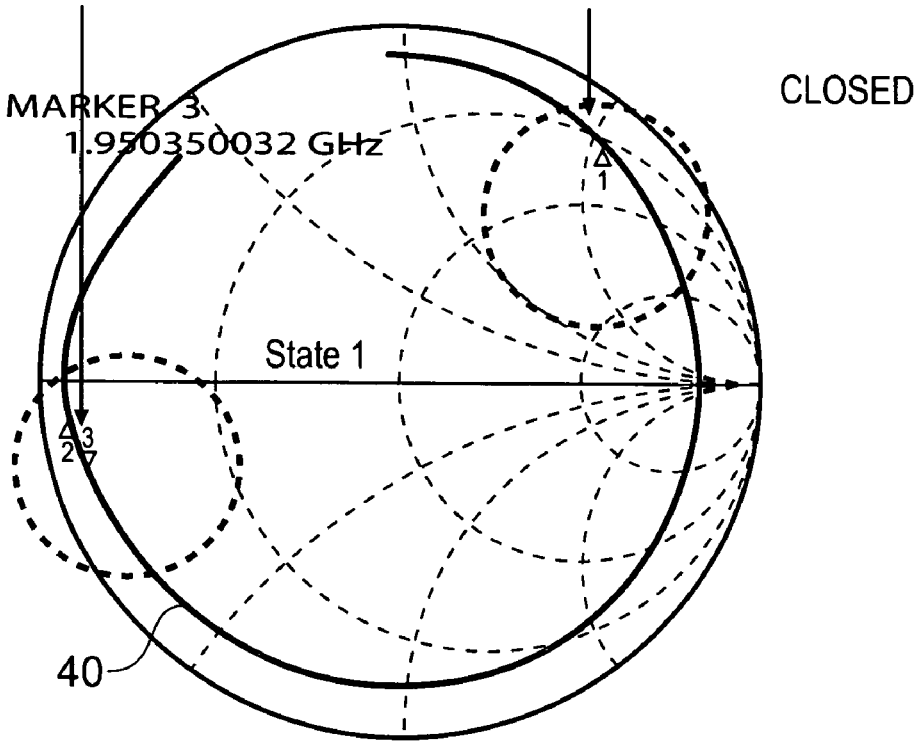
FIGS. 3A and 3B illustrate Smith Charts for one embodiment of the invention.
Figure 3B:
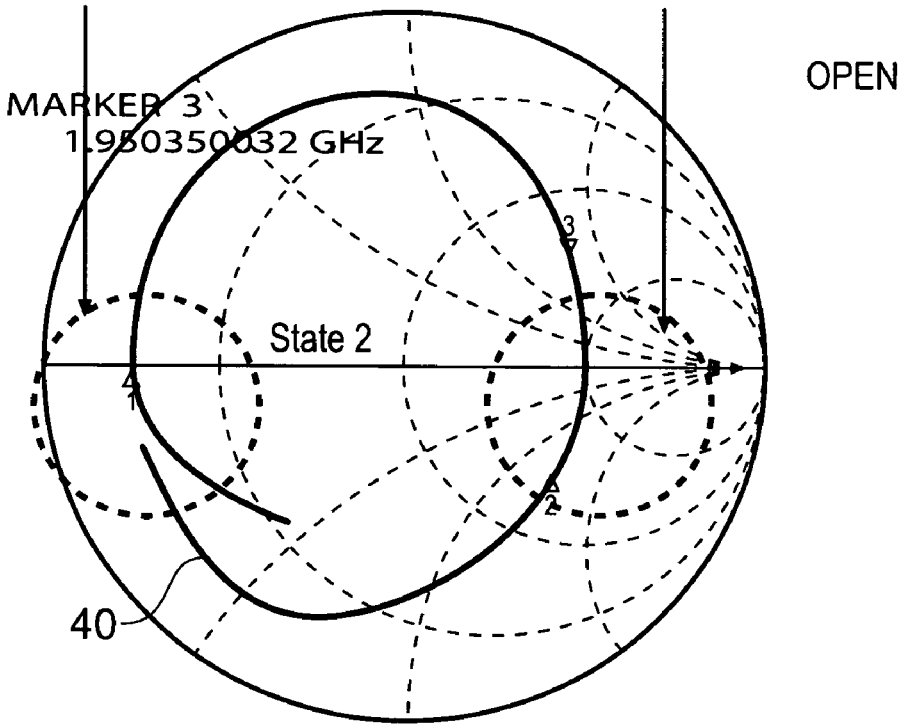

A Smith Chart for one example of the antenna arrangement 10, when the switch element 40 is closed, is illustrated in FIG. 3A and a Smith Chart for the same antenna arrangement 10, when the switch element 40 is open, is illustrated in FIG. 3B. The frequency 880 MHz is represented by marker 1, the frequency 2.17 GHz is represented by the marker 2 and the frequency 1.95 GHz is represented by the marker 3.

It will be appreciated that the lower frequencies F1*c* and F1*o*, in the vicinity of marker 1 on the trace 40, are located at a low impedance region of the Smith Chart when the switch element 40 is open and at a higher impedance portion of the Smith Chart when the switch element 40 is closed.

It will also be appreciated that the higher frequencies F2*o* and F2*c*, in the vicinity of markers 2 and 3 on the trace, are located at a low impedance region of the Smith Chart when the switch element 40 is closed and a higher impedance portion of the Smith Chart when the switch element 40 is open.

It is believed that the low impedance for the lower frequencies F1*c* and F1*o*, when the switch element 40 is open, results in the radiating element 20 capacitively coupling to the ground plane 12 via the tuning element 30. This enables resonant modes to be coupled from the ground plane 12 via the tuning element 30 to the radiating element 20 and results in a large bandwidth at the lower frequencies F1*c* and F1*o*. However, when the switch element 40 is closed, the higher impedance for the lower frequencies F1*c* and F1*o* results in the tuning element 30 no longer effectively coupling the radiating element 20 to the ground plane 12. The bandwidth at the lower frequencies is therefore narrower and the resonant frequency different, in this example higher.

It is believed that the low impedance for the higher frequencies F2*c* and F2*o*, when the switch element 40 is closed, results in the radiating element 20 inductively coupling to the grounded tuning element 30. This enables resonant modes to be coupled from the tuning element 30 to the radiating element 20. The tuning element 30 is designed to have an electrical length in the region of $\lambda/4$ (for F2*c*) and hence a resonant mode at approximately F2*c*. This resonant mode is coupled to the radiating element 20 across the gap 17 and results in a large bandwidth at the higher frequencies. However, when the switch element 40 is open, the higher impedance for the higher frequencies F2*o* and F2*c* results in the tuning element 20 no longer effectively coupling the radiating element 20 to the tuning element 30 at these frequencies. Furthermore, the disconnection of the tuning element 30 from the ground plane 12 stops it resonating.

The proximity of the tuning element 30 to the ground plane 12 prevents the tuning element 30 radiating when the switch element 40 is closed. It also assists coupling of the radiating element 20 to the ground plane 12 via the tuning element 30 at the low frequencies when the switch element 40 is open.

The proximity of the tuning element 30 to the radiating element 20 is believed to assist coupling between the grounded tuning element 30 and the radiating element 20 at the high frequencies when the switch element 40 is closed and between the tuning element 30 and the radiating element 20 at the low frequencies when the switch element 40 is open.

The electrical length of the tuning element 30 may be varied by changing its physical length or by placing a tuning circuit comprising lumped components between the switch element 40 and the tuning element 30 and by varying the tuning circuit.

Although embodiments of the present invention have been described in the preceding paragraphs with reference to various examples, it should be appreciated that modifications to the examples given can be made without departing from the scope of the invention as claimed. For example, although the preceding embodiment describes a monopole antenna, in other embodiments an IFA antenna may be used.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An antenna arrangement operable to transmit/receive in a first communications band and a second communications band, comprising:

a ground plane;

a first conductive element for transmitting/receiving;

a second conductive element separate from the first conductive element and the ground plane and having, at a first position that is closest to the first conductive element, a first inductive portion that is separated from the first conductive element and having, at a second position that is closest to the ground plane, a second capacitive portion that is separated from the ground plane; and a switch element for connecting/disconnecting the second conductive element to the ground plane, wherein, the first conductive element, when the switch element disconnects the second conductive element from the ground plane, is operable to transmit/receive in a first communications band and is inoperable to transmit/receive in a second communications band and the first conductive element, when the switch element connects the second conductive element to the ground plane, is operable to transmit/receive in the second communications band and inoperable to transmit/receive in the first communications band.

2. An antenna arrangement as claimed in claim 1, wherein the first conductive element is physically separated from the ground plane.

3. An antenna arrangement as claimed in claim 1, wherein the first conductive element is a monopole antenna.

4. An antenna arrangement as claimed in claim 1, wherein the proximity of the second capacitive portion of the second conductive element to the ground plane suppresses transmission/reception by the second conductive element.

5. An antenna arrangement as claimed in claim 1, wherein the second capacitive portion of the second conductive element comprises a terminating free-end of the second conductive element.

6. An antenna arrangement as claimed in claim 1, wherein the first inductive portion of the second conductive element comprises a bend in the second conductive element.

7. An antenna arrangement as claimed in claim 1, wherein the first position is adjacent a region of high H-field of the first conductive element.

8. An antenna arrangement as claimed in claim 1, wherein the first position is adjacent a feed point for the first conductive element.

9. An antenna arrangement as claimed in claim 1, wherein the second conductive element is positioned and arranged so that the separation between the second capacitive portion of the second conductive element and the ground plane is less than the separation between the first inductive portion of the second conductive element and the first conductive element.

10. An antenna arrangement as claimed in claim 1, wherein the first conductive element, the second conductive element and the ground plane are relatively positioned and arranged so that, when the switch element disconnects the second element from the ground plane, the first inductive portion and the second capacitive portion of the second conductive element couple the ground plane to the first conductive element and when the switch element connects the second element to the ground plane, the grounded second conductive element couples via the first inductive portion to the first conductive element.

11. An antenna arrangement as claimed in claim 10, wherein the coupling between the first inductive portion of the grounded second conductive element and the first conductive element is predominantly inductive coupling.

12. An antenna arrangement as claimed in claim 10, wherein the coupling between the second capacitive portion of the second conductive element and the ground plane is predominantly capacitive coupling.

13. An antenna arrangement as claimed in claim 1, wherein the second conductive element has an electrical length corresponding to $\lambda/4$, where $\lambda$ is a wavelength of a frequency lying within the second communications band.

14. An antenna arrangement as claimed in claim 1 wherein the second communications band covers WCDMA2100.

15. A mobile cellular telephone comprising an antenna arrangement as claimed in claim 1.

16. A method of selectively controlling an antenna arrangement to operate in at least a first communications band or to operate in at least a second communications band, comprising:

controlling a resonance of a first conductive element to enable operation in the first communications band but disable operation in the second communications band by disconnecting a second conductive element from a ground plane, where the second conductive element is separate from the first conductive element and the ground plane and has, at a first position that is closest to the first conductive element, a first inductive portion, that is separated from the first conductive element and has at a second position that is closest to the ground plane, a second capacitive portion that is separated from the ground plane; and controlling the resonance of the first conductive element to enable operation in the second communications band and disable operation in the first communications band by connecting the second conductive element to the ground plane.

17. An antenna arrangement operable to transmit/receive in a first communications band and a second communications band, comprising:

a ground plane;

a first conductive element for transmitting/receiving;

a second elongate conductive element separate from the first conductive element and the ground plane and having at a position closest to, but separated from the first conductive element, a bend portion and having at a position closest to, but separated from the ground plane, a terminating free-end portion; and a switch element for connecting/disconnecting the second conductive element to the ground plane.

* * * * *